US007572184B2

(12) United States Patent
Baerlocher et al.

(10) Patent No.: US 7,572,184 B2
(45) Date of Patent: Aug. 11, 2009

(54) GAMING DEVICE HAVING AN IMPROVED OFFER/ACCEPTANCE BONUS SCHEME

(75) Inventors: Anthony J. Baerlocher, Reno, NV (US); Randall D. Mead, Reno, NV (US); Bayard S. Webb, Sparks, NV (US)

(73) Assignee: IGT, Reno, NV (US)

( * ) Notice: Subject to any disclaimer, the term of this patent is extended or adjusted under 35 U.S.C. 154(b) by 320 days.

(21) Appl. No.: 11/222,695

(22) Filed: Sep. 7, 2005

(65) Prior Publication Data

US 2006/0003837 A1 Jan. 5, 2006

Related U.S. Application Data

(63) Continuation of application No. 09/966,884, filed on Sep. 28, 2001, now Pat. No. 6,942,566.

(51) Int. Cl.
*A63F 9/24* (2006.01)

(52) U.S. Cl. ..... 463/25; 463/16; 463/20

(58) Field of Classification Search ..... 463/11–13, 463/16, 17, 20, 22, 25, 26, 27, 29, 30, 31, 463/42; 700/92; 273/138.1, 139, 142 B, 273/142 D See application file for complete search history.

(56) References Cited

U.S. PATENT DOCUMENTS 4,184,683 A 1/1980 Hooker
4,448,419 A 5/1984 Telnaes
4,582,324 A 4/1986 Koza et al.
4,624,459 A 11/1986 Kaufman
4,652,998 A * 3/1987 Koza et al. ..... 463/26

(Continued)

FOREIGN PATENT DOCUMENTS

EP 0219305 A2 8/1986

(Continued)

OTHER PUBLICATIONS

A Salute to Game Shows, The Price Is Right : Showcase Showdowns, Dec. 12, 2000, http://web.archive.org/web/20001212084800/http://schuminweb.com/game-shows/shows/price-is-right/showcase-showdowns.htm.*

(Continued)

*Primary Examiner*—Dmitry Suhol
*Assistant Examiner*—Damon J. Pierce
(74) *Attorney, Agent, or Firm*—K & L Gates LLP

(57) ABSTRACT

A gaming device and preferably a bonus round game of a gaming device that enables a player to initiate a randomly generated number, wherein said number determines the number of positions that a position marker will move along an enclosed path. Each time the marker lands upon a previously unmarked position, the game provides an award associated with that position to the player. When the marker lands upon a previously marked position, the game ends. The present invention also contemplates updating or changing the values of unmarked or unselected positions along the enclosed path by preferably adding to each unmarked or unselected position the value of the award of a previously selected position. That is, when the game randomly selects an unmarked position, the game provides the player with an award, wherein the game preferably replaces a previously achieved award with the award of the newly selected position.

29 Claims, 12 Drawing Sheets

U.S. PATENT DOCUMENTS

| | | | | |
|---|---|---|---|---|
| 4,695,053 | A | 9/1987 | Vazquez, Jr. et al. | |
| 4,743,022 | A * | 5/1988 | Wood | 463/13 |
| 4,991,848 | A | 2/1991 | Greenwood et al. | |
| 5,178,390 | A | 1/1993 | Okada | |
| 5,205,555 | A | 4/1993 | Hamano | |
| 5,342,047 | A | 8/1994 | Heidel et al. | |
| 5,456,465 | A | 10/1995 | Durham | |
| 5,522,142 | A | 6/1996 | Whited | |
| 5,524,888 | A | 6/1996 | Heidel | |
| 5,536,016 | A | 7/1996 | Thompson | |
| 5,542,669 | A | 8/1996 | Charron et al. | |
| 5,560,603 | A | 10/1996 | Seelig et al. | |
| 5,611,535 | A | 3/1997 | Tiberio | |
| 5,664,332 | A | 9/1997 | Whited et al. | |
| 5,711,525 | A | 1/1998 | Breeding | |
| 5,769,716 | A | 6/1998 | Saffari et al. | |
| 5,772,509 | A | 6/1998 | Weiss | |
| 5,775,692 | A | 7/1998 | Watts et al. | |
| 5,788,573 | A | 8/1998 | Baerlocher et al. | |
| 5,823,874 | A | 10/1998 | Adams | |
| 5,833,538 | A | 11/1998 | Weiss | |
| 5,848,932 | A | 12/1998 | Adams | |
| 5,851,148 | A | 12/1998 | Brune et al. | |
| 5,873,781 | A | 2/1999 | Keane | |
| 5,882,261 | A | 3/1999 | Adams | |
| 5,902,184 | A | 5/1999 | Bennett et al. | |
| 5,911,418 | A | 6/1999 | Adams | |
| 5,947,820 | A | 9/1999 | Morro et al. | |
| 5,951,397 | A | 9/1999 | Dickinson | |
| 5,964,463 | A | 10/1999 | Moore, Jr. | |
| 5,967,894 | A | 10/1999 | Kinoshita et al. | |
| 5,980,384 | A | 11/1999 | Barrie | |
| 5,984,781 | A | 11/1999 | Sunaga | |
| 5,997,400 | A | 12/1999 | Seelig et al. | |
| 5,997,401 | A | 12/1999 | Crawford | |
| 6,004,207 | A | 12/1999 | Wilson, Jr. et al. | |
| 6,015,346 | A | 1/2000 | Bennett | |
| 6,019,369 | A | 2/2000 | Nakagawa et al. | |
| 6,033,307 | A | 3/2000 | Vancura | |
| 6,056,642 | A | 5/2000 | Bennett | |
| 6,059,289 | A | 5/2000 | Vancura | |
| 6,059,658 | A | 5/2000 | Mangano et al. | |
| 6,062,980 | A | 5/2000 | Luciano | |
| 6,089,976 | A | 7/2000 | Schneider et al. | |
| 6,089,977 | A | 7/2000 | Bennett | |
| 6,089,978 | A | 7/2000 | Adams | |
| 6,093,102 | A | 7/2000 | Bennett | |
| 6,102,798 | A | 8/2000 | Bennett | |
| 6,120,031 | A | 9/2000 | Adams | |
| 6,126,541 | A | 10/2000 | Fuchs | |
| 6,126,542 | A | 10/2000 | Fier | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,146,273 | A | 11/2000 | Olsen | |
| 6,159,095 | A | 12/2000 | Frohm et al. | |
| 6,159,096 | A | 12/2000 | Yoseloff | |
| 6,159,097 | A | 12/2000 | Gura | |
| 6,159,098 | A | 12/2000 | Slomiany et al. | |
| 6,162,121 | A | 12/2000 | Morro et al. | |
| 6,168,520 | B1 | 1/2001 | Baerlocher et al. | |
| 6,168,523 | B1 | 1/2001 | Piechowiak et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,190,254 | B1 | 2/2001 | Bennett | |
| 6,190,255 | B1 * | 2/2001 | Thomas et al. | 463/20 |
| 6,203,429 | B1 | 3/2001 | Demar et al. | |
| 6,210,279 | B1 | 4/2001 | Dickinson | |
| 6,213,876 | B1 | 4/2001 | Moore, Jr. | |
| 6,213,877 | B1 * | 4/2001 | Walker et al. | 463/26 |
| 6,224,483 | B1 | 5/2001 | Mayeroff | |
| 6,231,442 | B1 | 5/2001 | Mayeroff | |
| 6,231,445 | B1 | 5/2001 | Acres | |
| 6,261,177 | B1 | 7/2001 | Bennett | |
| 6,302,790 | B1 | 10/2001 | Brossard | |
| 6,305,686 | B1 | 10/2001 | Perrie et al. | |
| 6,309,300 | B1 | 10/2001 | Glavich | |
| 6,328,649 | B1 | 12/2001 | Randall et al. | |
| 6,342,007 | B1 | 1/2002 | Wood et al. | |
| 6,375,187 | B1 | 4/2002 | Baerlocher | |
| 6,406,369 | B1 | 6/2002 | Baerlocher et al. | |
| 6,413,161 | B1 | 7/2002 | Baerlocher et al. | |
| 6,445,778 | B1 * | 9/2002 | Stevens | 379/93.13 |
| 6,464,582 | B1 * | 10/2002 | Baerlocher et al. | 463/20 |
| 6,494,785 | B1 | 12/2002 | Gerrard et al. | |
| 6,506,118 | B1 | 1/2003 | Baerlocher et al. | |
| 6,514,141 | B1 | 2/2003 | Kaminkow et al. | |
| 6,569,013 | B1 * | 5/2003 | Taylor | 463/13 |
| 6,569,015 | B1 | 5/2003 | Baerlocher et al. | |
| 6,585,591 | B1 | 7/2003 | Baerlocher et al. | |
| 6,595,854 | B2 | 7/2003 | Hughs-Baird et al. | |
| 6,599,192 | B1 | 7/2003 | Baerlocher et al. | |
| 6,605,002 | B2 * | 8/2003 | Baerlocher | 463/25 |
| 6,607,438 | B2 * | 8/2003 | Baerlocher et al. | 463/16 |
| 6,632,141 | B2 | 10/2003 | Webb et al. | |
| 6,648,754 | B2 | 11/2003 | Baerlocher et al. | |
| 6,659,864 | B2 | 12/2003 | McGahn et al. | |
| 6,692,355 | B2 | 2/2004 | Baerlocher et al. | |
| 6,719,632 | B2 | 4/2004 | Palmer et al. | |
| 6,722,981 | B2 | 4/2004 | Kaminkow et al. | |
| 6,722,982 | B2 | 4/2004 | Kaminkow et al. | |
| 6,749,502 | B2 * | 6/2004 | Baerlocher | 463/16 |
| 6,758,750 | B2 | 7/2004 | Baerlocher et al. | |
| 6,769,184 | B1 | 8/2004 | Whited | |
| 6,776,711 | B1 | 8/2004 | Baerlocher | |
| 6,780,103 | B2 * | 8/2004 | Bansemer et al. | 463/7 |
| 6,786,820 | B2 | 9/2004 | Gerrard et al. | |
| 6,793,579 | B2 | 9/2004 | Baerlocher et al. | |
| 6,796,899 | B2 * | 9/2004 | Baerlocher | 463/16 |
| 6,796,900 | B2 * | 9/2004 | Baerlocher et al. | 463/16 |
| 6,796,905 | B2 | 9/2004 | Baerlocher et al. | |
| 6,808,452 | B2 | 10/2004 | Baerlocher et al. | |
| 6,808,454 | B2 | 10/2004 | Gerrard et al. | |
| 6,811,483 | B1 | 11/2004 | Webb et al. | |
| 6,848,995 | B1 * | 2/2005 | Walker et al. | 463/25 |
| 6,852,030 | B2 | 2/2005 | Baerlocher et al. | |
| 6,890,257 | B2 | 5/2005 | Baerlocher | |
| 6,899,623 | B2 | 5/2005 | Baerlocher | |
| 6,942,566 | B2 | 9/2005 | Baerlocher et al. | |
| 6,942,567 | B2 | 9/2005 | Baerlocher et al. | |
| 6,960,132 | B2 | 11/2005 | Baerlocher et al. | |
| 6,966,833 | B2 | 11/2005 | Kaminkow et al. | |
| 6,971,953 | B2 | 12/2005 | Gerrard et al. | |
| 7,001,273 | B2 | 2/2006 | Baerlocher | |
| 7,235,009 | B2 | 6/2007 | Baerlocher | |
| 7,235,010 | B2 | 6/2007 | Baerlocher | |
| 7,250,001 | B2 | 7/2007 | Baerlocher et al. | |
| 2002/0052232 | A1 * | 5/2002 | Kaminkow | 463/20 |
| 2002/0077165 | A1 * | 6/2002 | Bansemer et al. | 463/7 |
| 2002/0137559 | A1 * | 9/2002 | Baerlocher | 463/16 |
| 2002/0142821 | A1 * | 10/2002 | Baerlocher | 463/16 |
| 2002/0142822 | A1 * | 10/2002 | Baerlocher et al. | 463/16 |
| 2002/0155883 | A1 * | 10/2002 | Baerlocher | 463/25 |
| 2003/0036430 | A1 | 2/2003 | Cannon | |
| 2003/0045344 | A1 * | 3/2003 | Webb et al. | 463/20 |
| 2003/0045348 | A1 * | 3/2003 | Palmer et al. | 463/25 |
| 2003/0054877 | A1 * | 3/2003 | Baerlocher | 463/25 |
| 2003/0060255 | A1 * | 3/2003 | Baerlocher et al. | 463/16 |
| 2003/0060277 | A1 * | 3/2003 | Webb et al. | 463/25 |
| 2003/0064792 | A1 * | 4/2003 | Baerlocher et al. | 463/25 |
| 2003/0064795 | A1 * | 4/2003 | Baerlocher et al. | 463/25 |
| 2004/0038729 | A1 | 2/2004 | Webb et al. | |
| 2004/0180710 | A1 | 9/2004 | Palmer et al. | |

| | | | |
|---|---|---|---|
| 2004/0185928 | A1 | 9/2004 | Baerlocher et al. |
| 2004/0214632 | A1 | 10/2004 | Cuddy et al. |
| 2005/0020346 | A1 | 1/2005 | Baerlocher |
| 2005/0032567 | A1 | 2/2005 | Baerlocher et al. |
| 2005/0037829 | A1 | 2/2005 | Baerlocher et al. |
| 2005/0101375 | A1 | 5/2005 | Webb et al. |
| 2005/0130729 | A1 | 6/2005 | Baerlocher et al. |
| 2005/0187010 | A1 | 8/2005 | Baerlocher |
| 2005/0266914 | A1 | 12/2005 | Baerlocher et al. |

FOREIGN PATENT DOCUMENTS

| | | | |
|---|---|---|---|
| EP | 0449433 | A2 | 4/1991 |
| EP | 0482351 | A2 | 4/1992 |
| EP | 0874337 | A1 | 10/1998 |
| EP | 0926645 | A2 | 6/1999 |
| EP | 0944030 | A2 | 9/1999 |
| EP | 0945837 | A2 | 9/1999 |
| EP | 0974431 | A1 | 1/2000 |
| EP | 0981119 | A2 | 2/2000 |
| EP | 0984408 | A2 | 3/2000 |
| EP | 0984409 | A2 | 3/2000 |
| GB | 2090690 | | 7/1982 |
| GB | 2170636 | | 8/1986 |
| GB | 2191030 | | 2/1987 |
| GB | 2183882 | | 6/1987 |
| GB | 2333880 | A | 8/1999 |
| WO | WO 97/32285 | | 9/1997 |
| WO | WO 00/12186 | | 3/2000 |
| WO | WO 03/102844 | A2 | 12/2003 |

OTHER PUBLICATIONS

Addams Family Advertisement and Article written by IGT, Strictly Slots, published in 2000.
Adders and Ladders Advertisement written by Barcrest Ltd., published prior to 2000.
American Thunder Screen Shots written by IGT, published in 1998.
Big Bang Piggy Bankin Advertisement written by WMS Gaming, Inc., published prior to 2000.
Blackjack/Twenty-One Description written by Hoyle's Rules of Games, published in 1993.
Bonus Spin Red, White & Blue Advertisement written by IGT, published in 2000.
Bonus Times Article written by Strictly Slots, published in 2000.
Caribbean Gold II Advertisement written by Aristocrat Incorporated, published in 1998.
Cash Box Advertisement & Article written by Anchor Games, Strictly Slots, published in 2000.
Chutes & Ladders Game Instructions written by Hasbro-Milton Bradley, published in 1999.
Description of Let's Make a Deal Television Show written by letsmakeadeal.com (2 pages), printed on Mar. 16, 2001.
Double Diamond Game Descriptions written by IGT printed on Mar. 21, 2001.
Double Up Poker Game Description written by IGT Undated.
Easy Street Advertisements and Articles written by Casino Data Systems, published in 2000.
Elvis Advertisement written by IGT, published in 1999.
Empire Game Advertisement written by AC Coin, published in 1996.
Fire and Fortune Article written by Strictly Slots, published in 2001.
Fox "N" Hound Advertisement written by IGT, published in 2000.
IGT, S-Plus Limited: Take Your Pick, 1999, see entire handout.
In Between Game Description written by IGT, available prior to 2000.
Jackpot Party Advertisements and Articles written by WMS Gaming, Inc., published in 1998.
Keep Your Hat On Advertisement written by Aristocrat, published in 2001.
Let's Make A Deal Advertisement written by Shuffle Master and IGT, published in 2001.
Let's Make a Deal Game Advertisement written by Bally Gaming Systems, published in 1999.
Let's Make a Deal geocities.com (2 pages), printed on Mar. 16, 2001.
Let's Make a Deal written by fortunecity.com (4 pages), printed on Mar. 21, 2001.
Let's Make a Deal written by geocities.com (10 pages), printed on Mar. 21, 2001.
Let's Make a Deal written by Illinoislottery.com (1 page), printed on Mar. 21, 2001.
Little Green Men Advertisement and Article written by IGT, Strictly Slots, published in 2000.
MegaJackpots Advertisement written by IGT, published in 1998.
Money Grab Article written by Strictly Slots, published in Apr. 2001.
Money in the Bank Advertisement written by Strictly Slots Konami, published in 2001.
Monopoly Advertisements and Articles written by WMS Gaming, Inc., Strictly Slots, published in 1998, 1999, 2000.
Monopoly Party Train Article written by Strictly Slots, published in 2002.
Neon Nights written by IGT, published in 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Advertisement written by IGT/Anchor Gaming, published in 1999.
Take Your Pick Article written by Strictly Slots, published in Mar. 2001.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Cat Advertisement written by WMS Gaming, Inc., published prior to 2000.
Top Dollar Game Advertisement written by IGT, published in 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming, Inc., published in 1998.

* cited by examiner

GAMING DEVICE HAVING AN IMPROVED OFFER/ACCEPTANCE BONUS SCHEME

PRIORITY CLAIM

This application is a continuation application of, claims priority to and the benefit of U.S. patent application Ser. No. 09/966,884, filed on Sep. 28, 2001 now U.S. Pat. No. 6,942, 566, which is incorporated herein in its entirety.

CROSS REFERENCE TO RELATED APPLICATIONS

This application is related to the following commonly-owned co-pending patent applications: "GAMING DEVICE HAVING IMPROVED OFFER AND ACCEPTANCE GAME WITH MASKED OFFERS," Ser. No. 10/086,014, "GAMING DEVICE HAVING AN OFFER AND ACCEPTANCE SELECTION BONUS SCHEME WITH A TERMINATOR AND AN ANTI-TERMINATOR," Ser. No. 10/644, 447,"GAMING DEVICE HAVING AN AWARD OFFER AND TERMINATION BONUS SCHEME," Ser. No. 10/810, 146,"GAMING DEVICE HAVING OFFER/ACCEPTANCE ADVANCE THRESHOLD AND LIMIT BONUS SCHEME,"Ser. No. 10/925,561,"GAMING DEVICE HAVING IMPROVED AWARD OFFER BONUS SCHEME," Ser. No. 10/937 664, "GAMING DEVICE HAVING IMPROVED AWARD OFFER BONUS SCHEME," Ser. No. 10/952,062,"GAMING DEVICE HAVING AN AWARD EXCHANGE BONUS ROUND AND METHOD FOR REVEALING AWARD EXCHANGE POSSIBILITIES," Ser. No. 10/982,518, "GAMING DEVICE HAVING RISK EVALUATION BONUS ROUND," Ser. No. 11/041,801, "GAMING DEVICE HAVING AN OFFER AND ACCEPTANCE GAME WITH A TERMINATION LIMIT WHEREIN THE OFFER IS PICKED BY A PLAYER," Ser. No. 11/256,417, "GAMING DEVICE HAVING OFFER AND ACCEPTANCE GAME WITH HIDDEN OFFER," Ser. No. 11/338,961,and "GAMING DEVICE HAVING MULTIPLE ROUND BONUS SCHEME WITH RESIDUAL AWARDS," Ser. No. 11/687,359.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having an improved offer/acceptance bonus scheme, wherein the player sequentially risks achieved offers for higher value offers, and wherein the game adds the value of selected offers to remaining selectable offers.

BACKGROUND

Gaming devices currently exist with games and specifically bonus games in which a player has one or more opportunities to select masked bonus awards from a group of masked awards displayed to the player. When the player selects a masked award, the player receives the value of the award, and the game typically displays a message that the player may continue and enables the player to select another masked award. The player then selects another masked award, and the process continues until the player selects a masked terminator. European Patent Application No. EP 0 945 837 A2 filed on Mar. 18, 1999 and assigned on its face to WMS Gaming, Inc. discloses a bonus scheme of this type.

Gaming machines also currently exist in which the game selects or determines the player's award. PCT application number PCT/AU97/00121 entitled, Slot Machine Game with Roaming Wild Card, published on Sep. 4, 1997, discloses this type of game. This application discloses a slot machine having a video display displaying a plurality of rotatable reels with game symbols. When the player receives a triggering symbol or combination, the game produces a bonus symbol. The bonus symbol moves from game symbol to game symbol temporarily changing the game symbol to a bonus symbol. If the change results in a winning combination, the player receives an award.

In the first known game, the player blindly selects masked awards until selecting the bonus terminator, which is immediately displayed. The player knows nothing about the location of any particular award, and there is no logical incentive to select any particular masked award as opposed to any another masked award. Choosing a masked award also poses no risk to a previously accumulated award. That is, there is no incentive to stop selecting. The only course of action is for the player to continue selecting until the player selects a terminator. The player's involvement in the bonus round and the player's level of enjoyment and excitement from the bonus round is thus limited.

The second known game has even less player interaction. The game completely determines the bonus round award, and the player has no effect on the outcome. The player is a mere observer to the bonus round sequence and participates only by receiving an award. In both games, the player is not prompted to calculate, weigh options, or explore any consequences of any action. To increase player excitement and enjoyment, it is desirable to provide a gaming device, and more specifically a bonus round of a gaming device, which prompts a player to calculate, weigh options and explore the consequences of the player's selection.

Another type of game enables players to accept or decline multiple award offers. TOP DOLLAR™, which is manufactured and distributed by the assignee of this application, provides the player with three offers and a final award. When an offer is given, the player may accept or reject it by pushing an accept button or indicator or a reject button or indicator, respectively. If the player accepts an offer, the player receives the accepted bonus amount and the bonus round terminates. If the player declines an offer, the game generates another offer for the player.

In the known offer/acceptance game, when the player rejects an offer, the player attempts to switch a current or guaranteed award for a higher value award. The game may instead provide a lower award. The game thus creates a risk for the player. The player does not have an opportunity to accumulate awards or offers. Enabling a player to accumulate awards or offers provides excitement and enjoyment to a player. A need therefore exists to provide an offer/acceptance game that enables a player to weigh options and explore the consequences of the player's selection and that enables a player to accumulate the awards or offers.

SUMMARY

The gaming device of the present invention includes an improved offer and acceptance bonus game having a plurality of related sets of potential offers. The game randomly selects an offer to make to the player from a first set of potential or possible offers. The player may accept or reject this offer. If the player rejects the offer from the first set, the game uses that offer to modify at least one, and in one embodiment all, of the other offers in the first set of offers, thereby forming a second set of potential offers. The game then randomly selects an offer to make to the player from the second set of offers, which includes at least one, and in one embodiment all, of the offers modified based on the first offer rejected by the player. Such offers may be modified by adding the rejected offer to the potential offer or may otherwise be modified by changing the offer based on the rejected offer.

As indicated above, in one embodiment, the second set of offers includes each offer in the first set plus the value of the offer made to the player from the first set. In one embodiment, the offer made to the player in the first set is thereafter not included in the second set. Accordingly, the present invention provides for subsequent potential offers made to the player based on modifications of previous offers made to the player and rejected by the player. It should be appreciated that the subsequent offers could alternatively be modified based on a previous offer even if such offer was not made to the player.

One preferred embodiment of the present invention provides a gaming device and specifically a bonus round of a gaming device, in which the offers in the sets of offers are displayed to the player in positions. The player initiates the selection of a randomly generated number. The number determines the number of positions that a position marker will move along an enclosed path. Each time the marker lands upon a previously unmarked position, the game makes an offer to the player which is associated with that position. When the marker lands upon a previously marked or selected position (i.e., a position where an offer was previously made to the player), the game ends.

The game preferably reveals all available offers to the player at all times. The game suitably marks a position after the position marker lands on it and may, but preferably does not, continue to reveal the offer associated with the marked position. The present invention preferably employs a video monitor so that the game displays a simulated enclosed path having simulated positions, reveals and masks offers and marks randomly selected or landed upon positions. Alternatively, the gaming device may employ suitable lights and display meters or other suitable mechanical devices.

The present invention further includes updating or changing the values of the unmarked or unselected positions along the enclosed or functionally circular path. The game preferably changes, and preferably increases updates or adds to each unmarked or unselected position the value of the offer of a previously selected position. That is, when the game randomly selects an unmarked position, the game provides the player with an offer, wherein the game preferably replaces a previously accrued offer with the offer of the newly selected position. The game also preferably adds the new offer to the offer associated with each and every unselected or unmarked position. Thus, at any given time, each offer bearing position has accumulated each and every offer provided to the player, and the game therefore replaces the potential offers as the game proceeds along the path. It should be appreciated that the game could alternatively use other suitable offer modification methods, such as changing the potential offers based on potential offers not previously made to the player, randomly increasing the offers, and increasing the offers using predetermined amounts.

When the game randomly selects a previously selected or marked position, the game of the present invention preferably ends and provides the player an award that is lower than the offer associated with the previously selected position. Accordingly, the game provides an accept or reject option to the player after each random position selection, so that the player can keep a currently achieved offer and end the game.

The game thus presents the player with an option to keep a currently achieved offer which (as described above) is in an accumulated offer, or continue and risk forfeiting the currently achieved offer. The player determines whether the remaining replacement offers are worth trying for, taking into account the number and relative position of the previously selected offers. The game provides suitable accept or reject selectors that are mechanical or areas of a touch screen video monitor.

The game also preferably maintains a consolation database containing one or more awards, one of which the game provides to the player after the player unsuccessfully tries to upgrade the offer made to the player. That is, when the game randomly selects a marked or previously selected position and the player forfeits the currently achieved offer, the game provides the player with a suitable consolation award. The game maintains a database, which preferably has a value for each turn or attempt at an offer upgrade or increase. In one embodiment, the game displays at least one of the consolation awards to the player, which can also figure into the player's decision to accept an offer or continue and try for an offer upgrade. The consolation awards preferably increase as the player progresses through the bonus round. Alternatively, the consolation awards may be determined in any suitable manner. For instance, the consolation awards may depend on the probability of landing on a marked position or an increased offer position, or may increase in the order of appearance of the consolation awards.

The game includes any enclosed or functionally circular path having any shape, any number of positions and any suitable method of random generation. In one preferred embodiment, the present invention provides a circular, rectangular or square shaped path having eight to twelve different positions and a random number generator that can generate any number one through six, or one roll of a die. In this embodiment, the game cannot complete the enclosed path upon one random number generation. Alternatively, the game includes generating any maximum position movement desired by the implementor. For instance, the game includes generating any number two through twelve, or one roll of two dice.

As indicated above, the present invention includes alternative embodiments that do not include a path, wherein the game does not randomly select awards based upon any spatial relationship between any two or more offers. Upon generation of an offer, the game updates any previously unselected offer with the generated offer. The alternative embodiment includes a sequentially increasing consolation award, such that when the player generates the same offer for a second time, the game ends and the player receives the consolation award.

The present invention includes a further alternative embodiment that does not include a path, wherein the game does not randomly select offers based upon any spatial relationship between any two or more offers and wherein the game does not include a consolation award. Upon generation of an offer, the game updates any previously unselected offers with the generated offer. The further alternative embodiment does not include a consolation award, such that when the player generates the same offer for a second time, or some other termination occurs, the game ends and the player receives the reselected offer.

It should also be appreciated that the game could provide a limited number of movements and that the path could be functionally linear so that the player could only play through the path once. In this embodiment, certain positions could be consolation awards or even terminators instead of accumulating offers.

It is therefore an advantage of the present invention to provide a gaming device having an improved offer/acceptance bonus game, wherein the player sequentially risks increasingly higher achieved offers for increasingly higher offers.

Another advantage of the present invention is to provide a gaming device having an improved offer/acceptance bonus game, wherein the game adds the value of selected offers to remaining selectable offers.

A further advantage of the present invention is to provide an enclosed path offer/acceptance bonus game.

Yet another advantage of the present invention is to provide an improved offer/acceptance bonus game, wherein the game provides sequentially increasing consolation awards.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

Gaming Device and Electronics

Figure 1A:
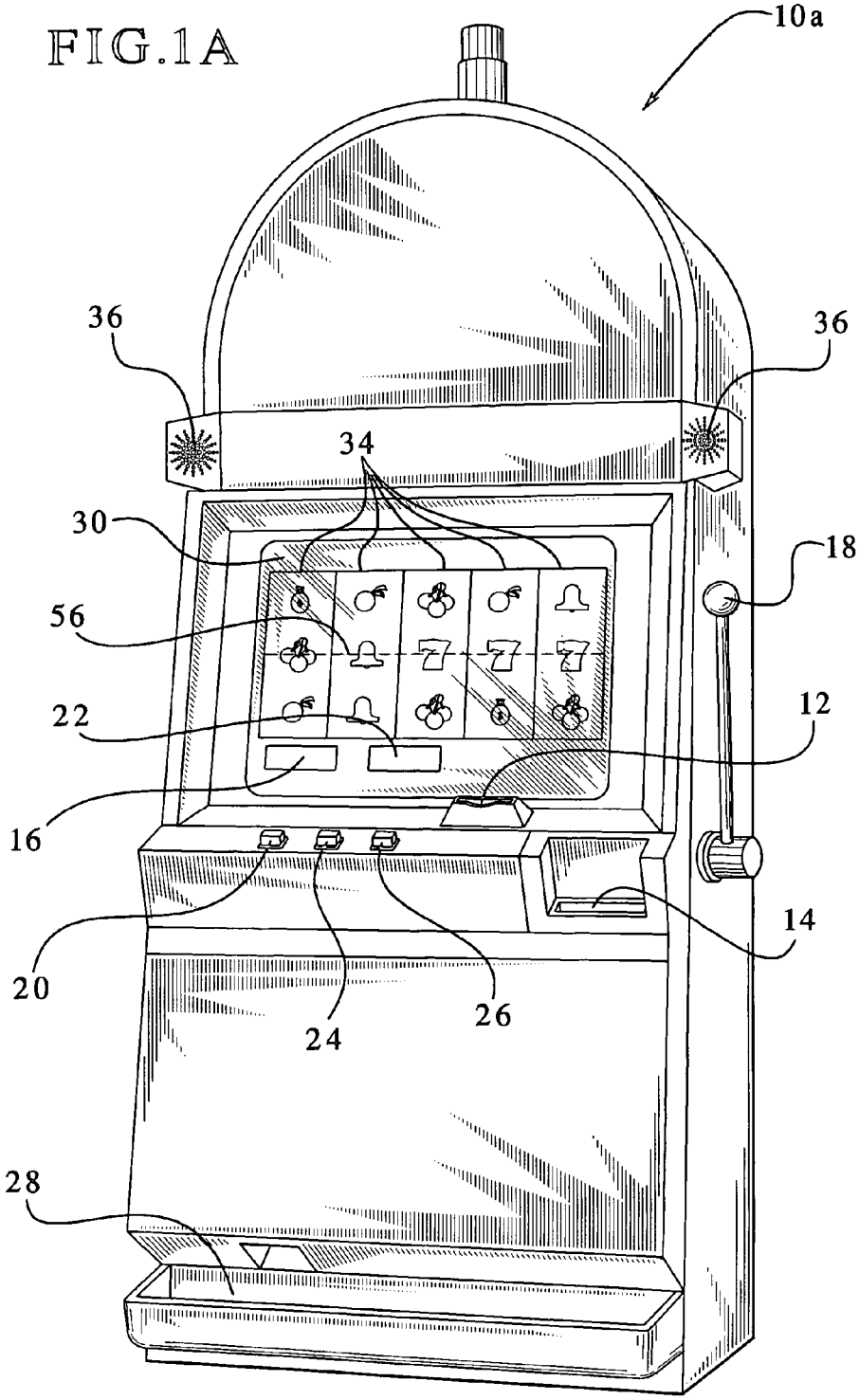
FIG. 1A is a front-side perspective view of one embodiment of the gaming device disclosed herein.
Figure 1B:
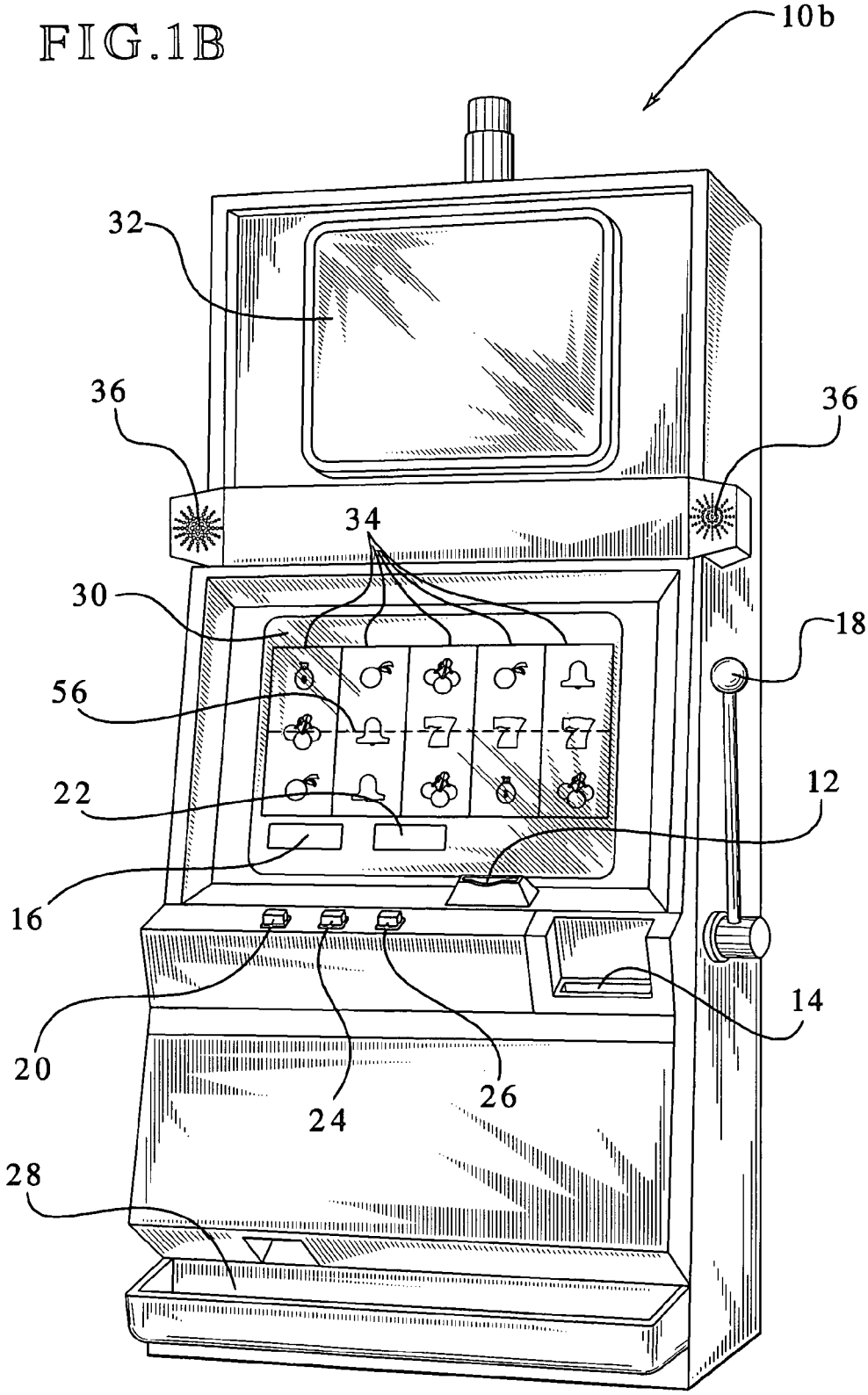
FIG. 1B is a front-side perspective view of another embodiment of the gaming device disclosed herein.

Referring now to the drawings, two embodiments of the gaming device are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player, which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit vouchers redeemable by a cashier or electronically recordable cards, which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other static or dynamic display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
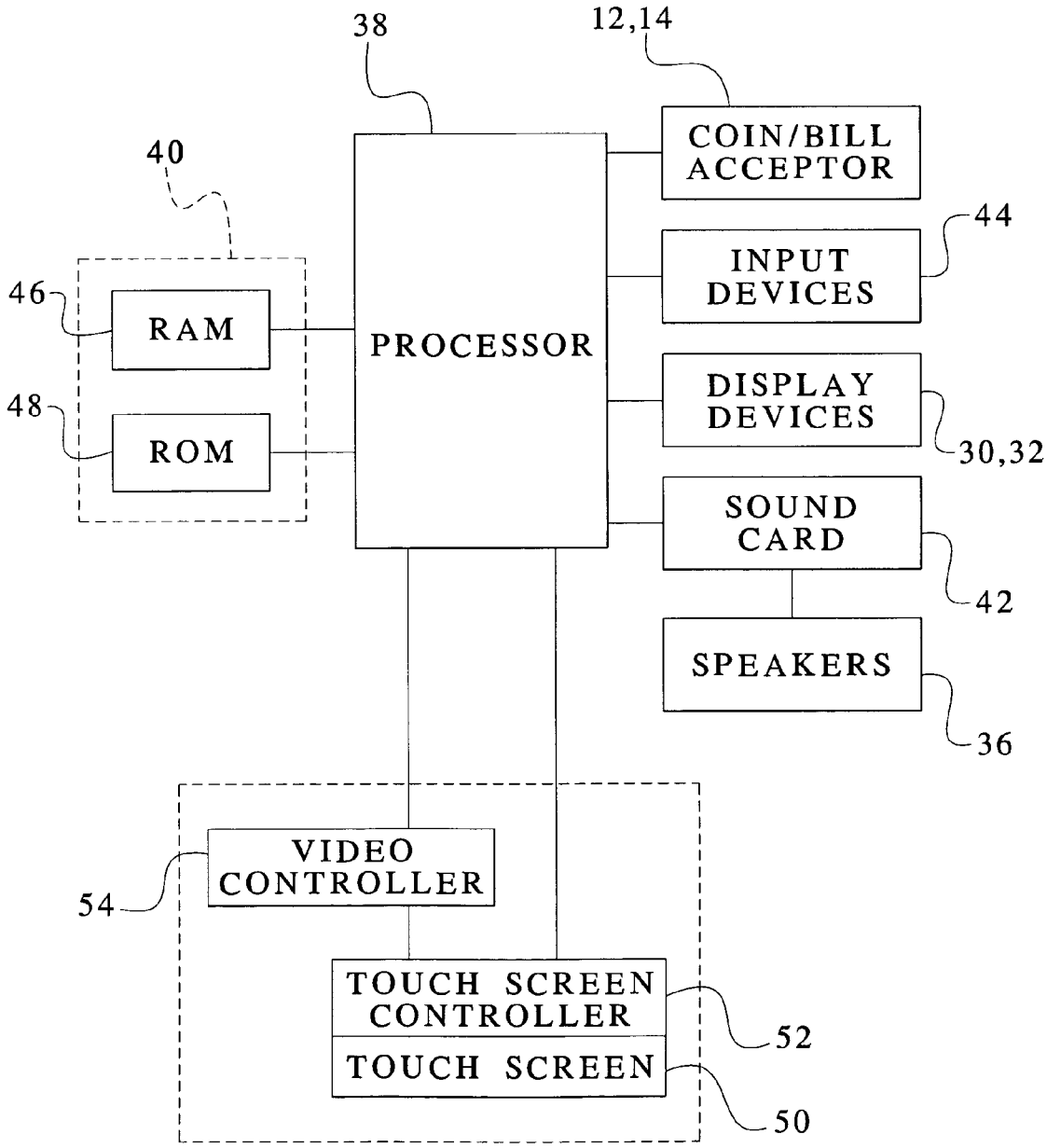
FIG. 2 is a schematic block diagram of the electronic configuration of one embodiment of the gaming device disclosed herein.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or the "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Displays and Tables

Figure 3:
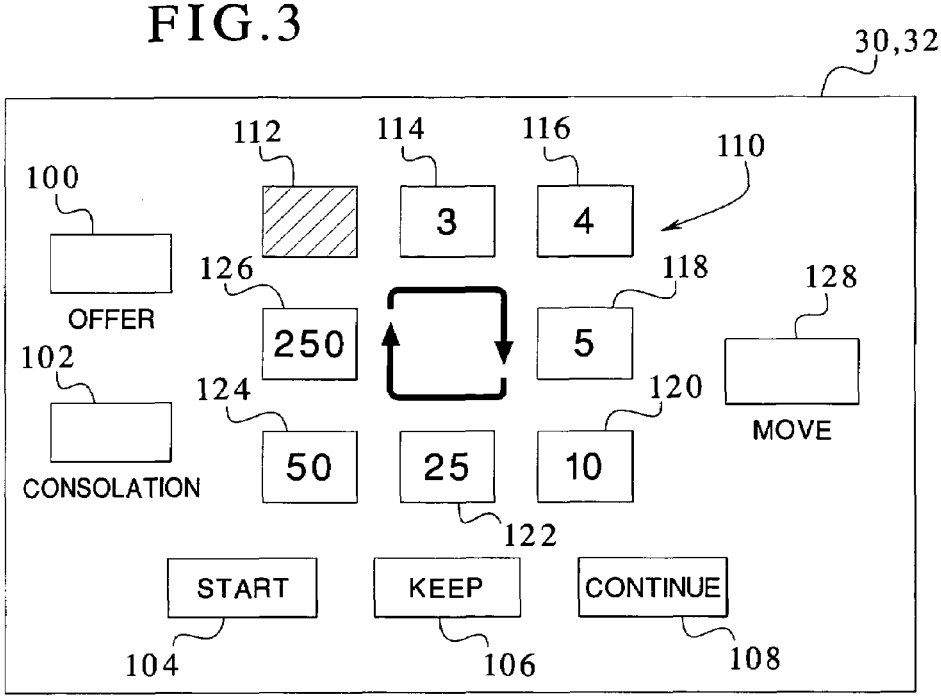
FIG. 3 is a front plan view of a display device illustrating an offer/acceptance path of one preferred embodiment disclosed herein.

Referring now to FIG. 3, the display device 30 or 32 illustrating one preferred embodiment includes an offer display or indicator 100, a consolation award display or indicator 102, a start button or selector 104, an accept or keep button or selector 106, a reject or continue button or selector 108, and a path 110 having eight different positions 112 through 126. It should be appreciated that the path may be square (as shown), rectangular, triangular, oval, circular or any other suitable shape. It should also be appreciated that the path is preferably enclosed, continuous or functionally cylindrical. A potential offer associated with each position is displayed in the position, although it should be appreciated that the potential offers could be masked. The game includes a position move indicator 128 which displays the currently generated number of position moves along the path 110.

The display device preferably includes a touch screen 50 and an associated touch screen controller 52 (FIG. 2). Each of the selectors 104, 106 and 108 on the display device is thus preferably a player selectable area, which sends a unique input signal to the controller of the gaming device. Alternatively, the present invention contemplates providing one or more front panel mountable input devices 33 illustrated schematically in FIG. 2, which are well known in the art, and which enable a player to play the game of the present invention.

Figure 4:
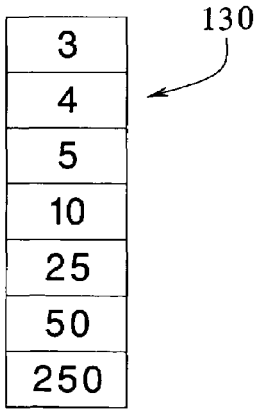
FIG. 4 is a table illustrating one possible method for initially supplying offers for one embodiment disclosed herein.

Referring now to FIG. 4, the preferred embodiment of the game includes a table 130 of initial offer values. The award table 130 includes sequentially increasing offer values displayed in positions 114 to 126 of FIG. 3. The present invention contemplates maintaining a plurality of tables, such as offer table 130, that have different offer value distributions, wherein the game randomly selects one of the tables whenever the game is invoked. The game can alternatively weight or attach different probabilities to the tables (not illustrated).

The offers employed in the game preferably sequentially increase in value as illustrated in offer table 130 and in the clockwise manner on the path 110 of FIG. 3. As described below, the offers on the path 110 represent potential offers that the player receives by landing on a position displaying the offer. The game displays the accumulated offer in the offer indicator 100. The offers displayed clockwise along the path 110 do not have to sequentially increase and can alternate in value or maintain any relative value distribution desired by the implementor. The implementor can also include any desired values, which can correspond to numbers of game credits, multiplier numbers, numbers corresponding to an amount of selections from a prize pool, or any other item of actual or potential value to the player.

Figure 5:
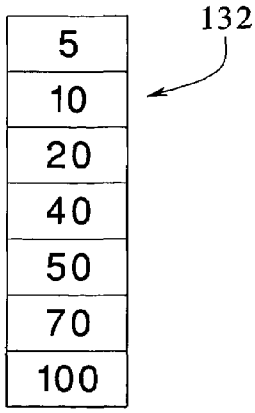
FIG. 5 is a table illustrating one possible method for supplying consolation award values for one embodiment disclosed herein.

Referring now to FIG. 5, the consolation table 132 illustrates one possible method for supplying consolation award values to the game. The consolation table 132 includes sequentially increasing consolation award values, one of which the game preferably displays in the consolation award indicator 102 of FIG. 3. The present invention contemplates maintaining a plurality of tables, such as consolation table 132 that have different consolation award distributions, wherein the game randomly selects one of the tables whenever the game is invoked. The game can alternatively weight or attach different probabilities to the tables (not illustrated).

The consolation awards preferably sequentially increase in value as illustrated in the consolation table 132. The consolation awards do not have to sequentially increase and can alternate in value or maintain any relative value distribution desired by the implementor. The implementor can also include any desired consolation award values, which preferably correspond to the same type of item of value, i.e., game credits, multiplier, etc. to which the offers of the offer table 130 of FIG. 4 correspond.

Figure 6:
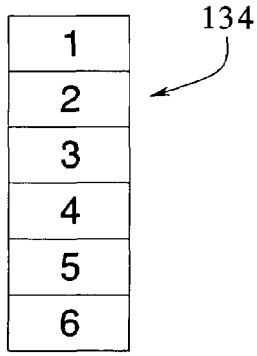
FIG. 6 is a table illustrating one possible method for supplying a randomly generated number of position moves along a path of one embodiment disclosed herein.

Referring now to FIG. 6, the move table 134 illustrates one method for supplying a randomly generated number of position moves along the path 110 of FIG. 3. The move table 134 includes a sequentially increasing number of position moves, one of which the game randomly generates when the player plays the game as described in detail below. The game can alternatively weight or attach different probabilities to the position move numbers (not illustrated).

The move table 134 includes the numbers one through six, wherein the game simulates the roll of a die by randomly generating one of the numbers. The game can alternatively include a position move table with the numbers two through twelve (not illustrated), wherein the game simulates the random roll of two dice. The game can include any move number distribution such as the distribution illustrated in the move table 134. The present invention also contemplates maintaining a plurality of tables, wherein the game randomly selects one of the tables whenever the game is invoked. The game can alternatively weight or attach different probabilities to the tables (not illustrated).

Operation

Figure 7:
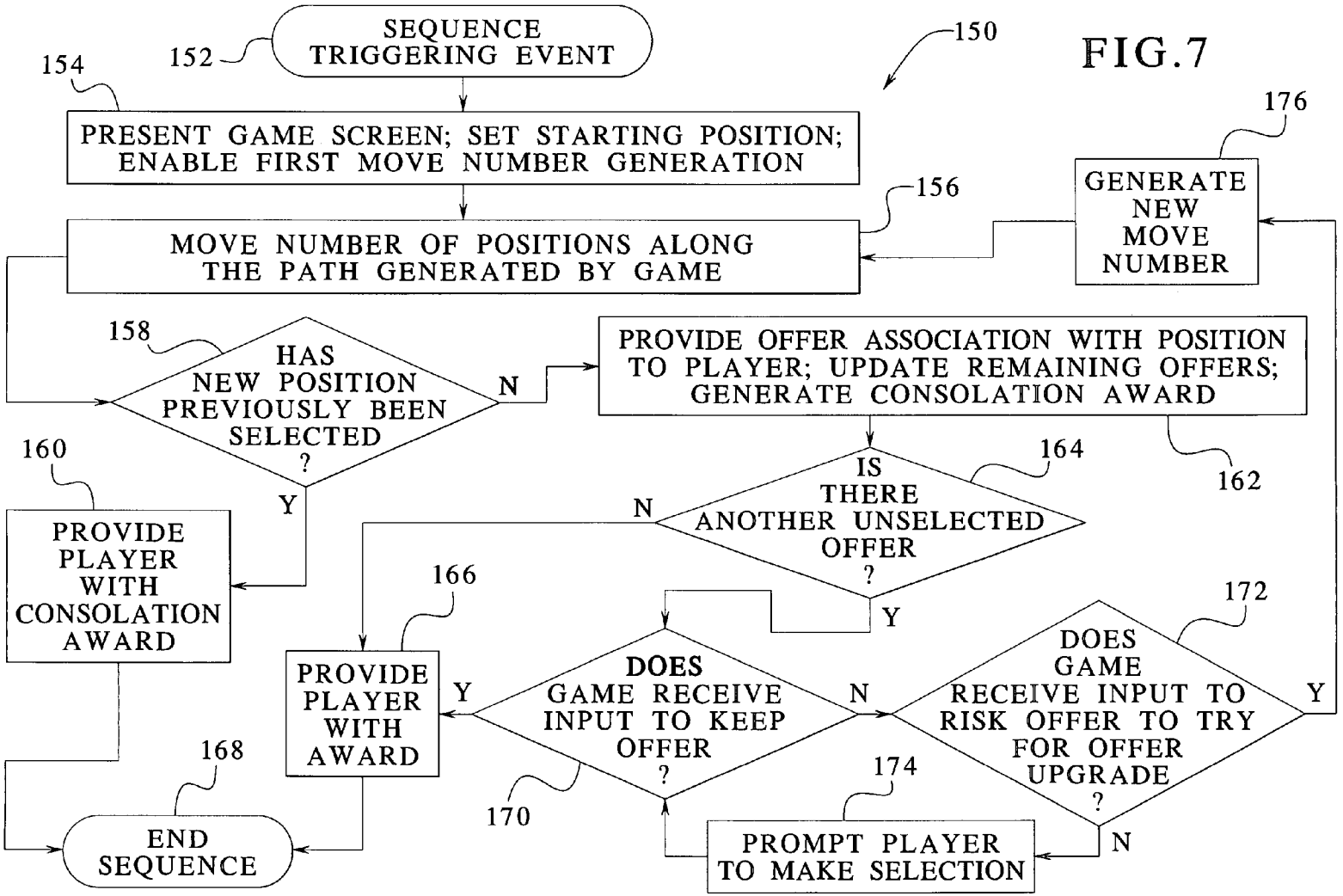
FIG. 7 is a flow diagram of the method of the preferred embodiment disclosed herein.

Referring now also to FIG. 7, upon a sequence triggering event, as indicated by oval 152, the game, as indicated by block 154: (i) displays a game screen, such as the screen of FIG. 3; (ii) sets a starting position of the position maker, such as the position 112 of FIG. 3; and (iii) enables the player to randomly generate a first move number, such as enabling the player to select the start selector 104. As described with respect to FIGS. 1A and 1B, the sequence triggering event, in a bonus game embodiment, can be a certain symbol or combination of symbols appearing on a payline 56. The sequence triggering event, in a stand-alone embodiment, can be the deposit of an appropriate amount of money.

The game moves the position marker a number of positions generated by the game, as indicated by block 156. The game determines whether the newly generated position has previously been selected or landed upon, as indicated by diamond 158. If the newly generated position has previously been selected or landed upon, the game provides the player with a consolation award, as indicated by the block 160. In a stand-alone embodiment, the consolation award can be zero or less than the amount necessary to initiate the sequence.

If the newly generated position has not previously been selected or landed upon, the game: (i) provides the selected or landed upon offer; (ii) updates the remaining offers; and (iii) generates a new consolation award, as indicated by block 162. The present invention contemplates a plurality of update methods as discussed below. Afterward, the game determines whether an unselected offer exists, as indicated by diamond 164.

If another unselected offer does not exist, the game provides the currently achieved offer to the player, as indicated by block 166. After the game provides the player with a consolation award, as indicated by block 160, or provides the currently achieved award to the player, as indicated by block 166, the sequence ends as indicated by oval 168.

If another unselected offer does exist, the game awaits the receipt of an input from the player to accept or keep the offer or to reject the offer to try for a larger offer, as indicated by diamond 170. When the player inputs a decision to accept or keep a currently achieved offer, the game provides the currently achieved offer to the player, as indicated by block 166. If another unselected offer exists, the game also awaits the receipt of an input from the player to reject an offer and risk a currently achieved offer to try for an offer upgrade, as indicated by diamond 172. If the player does not input either a decision to accept or keep an offer, or reject an offer and risk an offer, the game prompts the player to make a decision, as indicated by the block 174, and resets the decision loop.

When the player inputs a decision to reject an offer and risk a currently achieved offer to try for an offer upgrade, as indicated by a positive response to diamond 172, the game randomly generates a new position move number, as indicated by the block 176 and moves the number of positions generated by the game, as indicated by the block 156. The game thus continues the loop initiated when the gaming device moves the selected number of positions, as indicated by the block 156, until providing the player with a consolation award or a currently achieved offer.

Updating Remaining Offers

Figure 8:
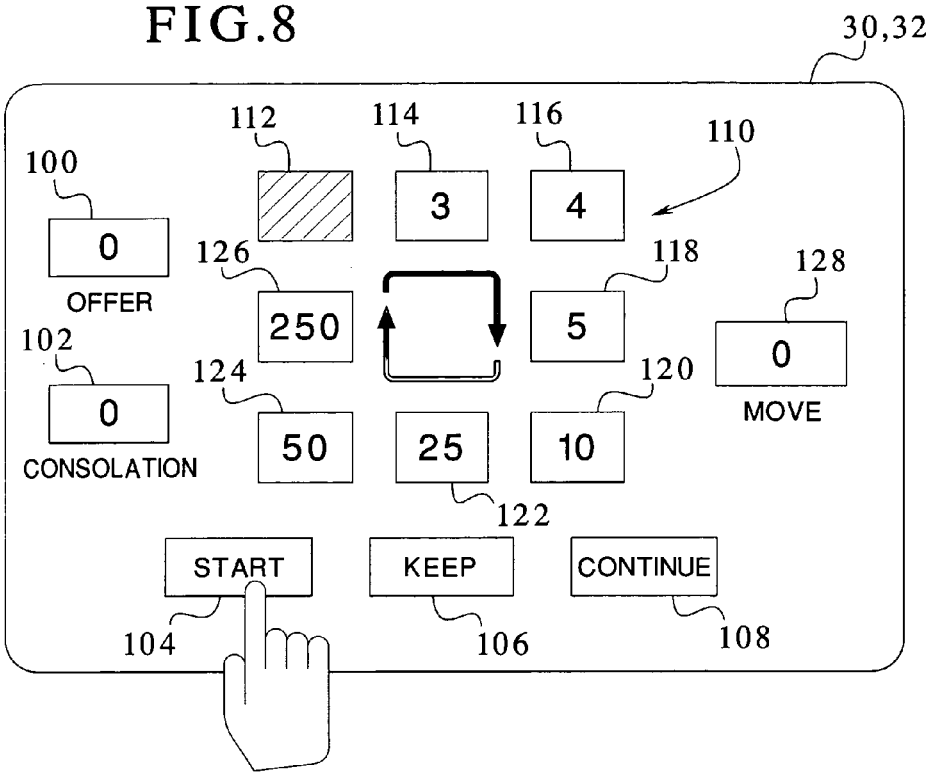
FIGS. 8 to 12 are front plan views of a display device illustrating example movements along the path of the preferred embodiment disclosed herein, wherein the game adds an offer associated with a randomly selected or landed upon position to the remaining unselected offers.

Two examples illustrate the offer update function. Referring now to FIG. 8, an enlarged front plan view of a display device 30 or 32 illustrates a first display of a preferred offer update embodiment, wherein the game adds a randomly selected or landed upon offer to the remaining unselected offers. Upon a sequence triggering event, one of the displays 30 or 32 shows the player that no offers exist in the offer indicator 100. The game has yet to generate a consolation award displayed in the consolation award indicator 102. The player has yet to input a decision enabling the game to generate a position move number, as indicated by the move indicator 128.

The displays 30 or 32 show that the game retrieves offers, e.g., from the offer table 130 of FIG. 4, and sequentially, increasingly displays the offers in the positions 114 through 126. The game selects and displays that the player starts from the position 112 and travels clockwise around the path 110. Initially, the game preferably enables the player to select the start selector 104 and not the offer/acceptance selectors, i.e., the keep selector 106 or the continue selector 108. Accordingly, the player in this example selects the start selector 104.

In a bonus round embodiment, the game preferably includes a move table, such as the move table 134 of FIG. 6, so that the player is guaranteed an offer. That is, even a maximum of six moves from the move table 134 does not return the player to the start position 112, which ends the sequence. The game guarantees that the player lands on and receives an offer from one of the positions 114 through 124. In a stand-alone embodiment, the game alternatively, preferably enables the player to return to the start position 112, which ends the sequence. In a stand-alone embodiment, the game preferably includes a position move table with numbers such as two through twelve, wherein the game simulates the random roll of two dice and enables the game to end upon an initial move.

Figure 9:
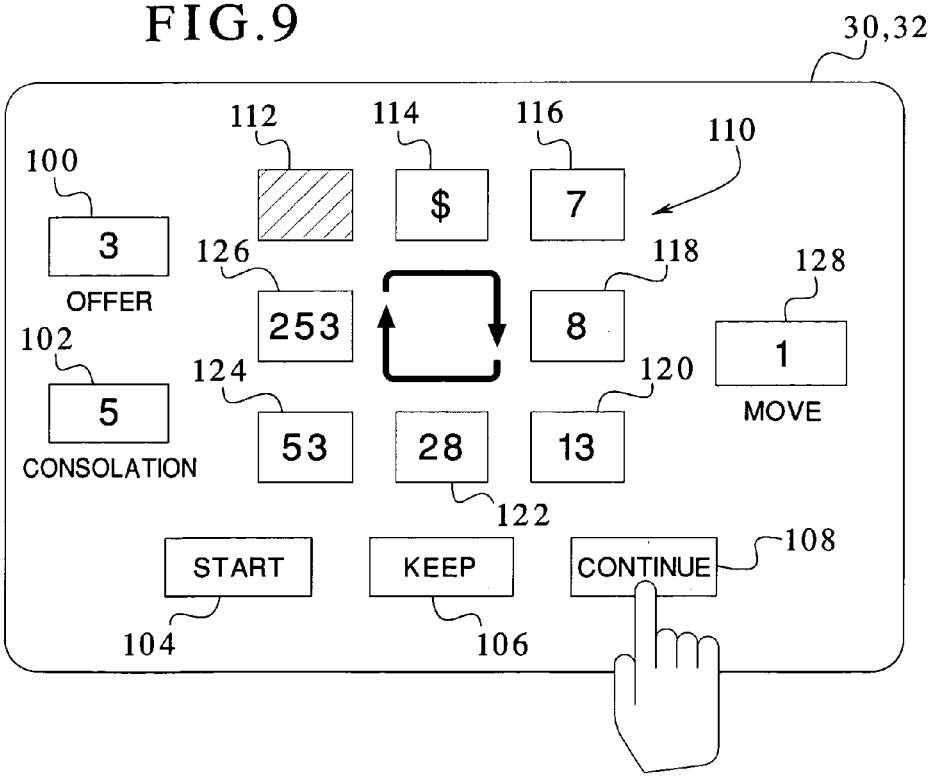

Referring now to FIG. 9, an enlarged front plan view of a display device 30 or 32 illustrates a second display of a preferred offer update embodiment, wherein the game adds a randomly selected or landed upon offer of three credits to the remaining unselected offers. As illustrated by the move indicator 128, when the player selects the start selector 104 (in FIG. 8), the game randomly generates a move of one position, e.g., by randomly selecting the number one from the move table 134 of FIG. 6. The game moves a marker 136, shown here as a "$," from the start position 112 one position to the position 114. The game offers the player the three credits previously displayed (in FIG. 8) by the position 114, as displayed in the offer indicator 100, and adds the three credits (i.e., the offer) to the remaining unselected selectors as illustrated in FIG. 9. The game also recalls a consolation award of five, e.g., from the consolation table 130 of FIG. 5, and displays the five credits in the consolation award indicator 102.

In the preferred embodiment, the game structures the offer table 130 and consolation award table 132 such that the game, in certain instances, produces a higher consolation award than game offer. In such a case, the player's obvious next step is to risk the currently achieved offer. The game may alternatively structure the offer table 130 and consolation award table 132, such that the currently achieved offer always exceeds the consolation award.

The game enables the offer/acceptance aspect of the present invention. That is, the player can accept or keep the currently achieved three credits (i.e., the offer) by selecting the keep selector 106. The player can alternatively reject the offer and risk the three credits for one of the upgrades in the remaining positions 116 through 126. If the player rejects the offer, by selecting the continue selector 108, and lands on either of the spent or marked positions 112 or 114, the game ends and the player receives the consolation award. In this example, the player rejects the offer and selects the continue selector 108, as illustrated.

Figure 10:
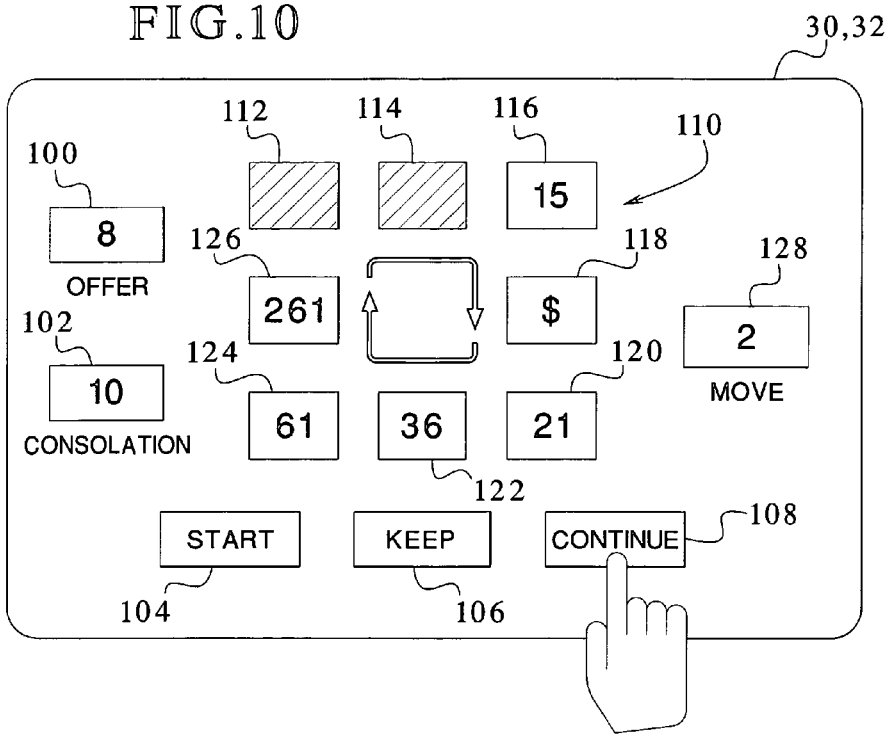

Referring now to FIG. 10, an enlarged front plan view of a display device 30 or 32 illustrates a third display of a preferred offer update embodiment, wherein the game adds a randomly selected or landed upon offer of eight credits to the remaining unselected offers. As illustrated by the move indicator 128, when the player selects the continue selector 108 (in FIG. 9), the game randomly generates a move of two positions, e.g., by randomly selecting the number two from the move table 134 of FIG. 6. The game moves a marker 136, the $, from the previous position 114 two positions to the position 118. The game offers the player the eight credits previously displayed (in FIG. 9) by the position 118, as displayed in the offer indicator 100, and adds the eight credits to each of the remaining unselected positions. The game also retrieves a new consolation award of ten from the consolation table 130 of FIG. 5, and displays the ten credits in the consolation award indicator 102.

The game enables the offer/acceptance aspect of the present invention, wherein the player can accept or keep the currently achieved eight credits (i.e., the offer) by selecting the keep selector 106. The player can alternatively reject the offer and risk the eight credits for one of the offer upgrades in the remaining positions 116 and 120 through 126. If the player rejects the offer, by selecting the continue selector 108, and lands on any of the spent positions 112, 114 or 118, the game ends and the player receives the consolation award. In this example, the player again rejects the offer and selects the continue selector 108, as illustrated.

Figure 11:
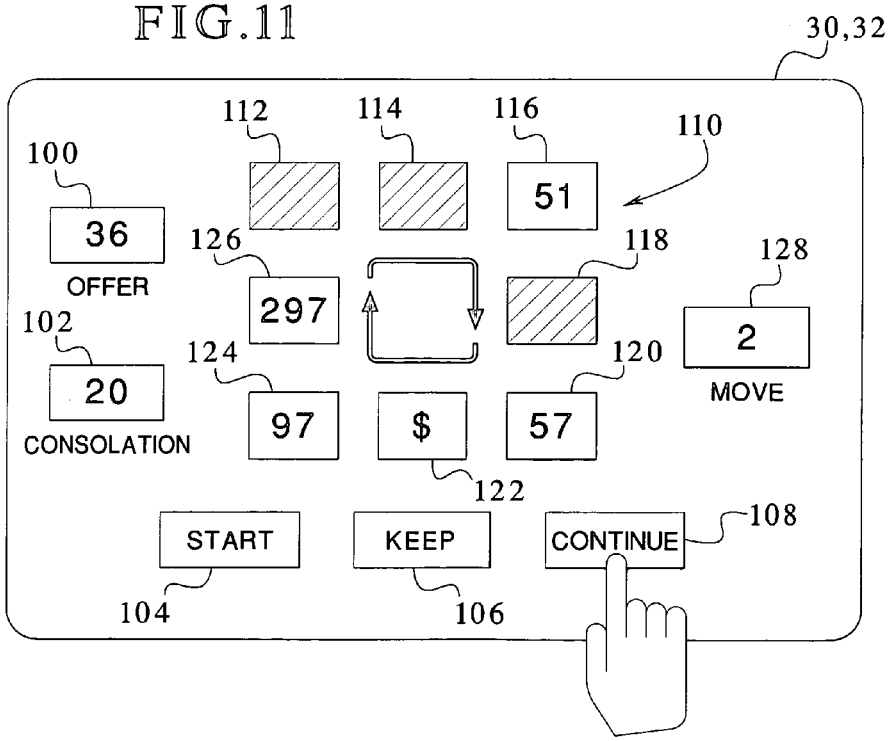

Referring now to FIG. 11, an enlarged front plan view of a display device 30 or 32 illustrates a fourth display of a preferred offer update embodiment, wherein the game adds a randomly selected or landed upon offer of thirty-six credits to the remaining unselected offers. As illustrated by the move indicator 128, when the player selects the continue selector 108 (in FIG. 10), the game again randomly generates a move of two positions, e.g., by randomly selecting the number two from the move table 134 of FIG. 6. The game moves a marker 136, the $, from the previous position 118 two positions to the position 122. The game offers the player the thirty-six credits previously displayed (in FIG. 10) by the position 122, as displayed in the offer indicator 100, and adds the thirty-six credits to each of the remaining unselected positions or offers. The game also retrieves a new consolation award of twenty, e.g., from the consolation table 130 of FIG. 5, and displays the twenty credits in the consolation award indicator 102.

The game enables the offer/acceptance aspect of the present invention, wherein the player can accept or keep the currently achieved thirty-six (i.e., the offer) credits by selecting the keep selector 106. The player can alternatively reject the offer and risk the thirty-six credits for one of the offer upgrades in the remaining positions 116, 120, 124 and 126. If the player continues, by selecting the continue selector 108, and lands on any of the spent positions 112, 114, 118 or 122, the game ends and the player receives the consolation award. In this example, the player again rejects the offer and selects the continue selector 108, as illustrated.

Figure 12:
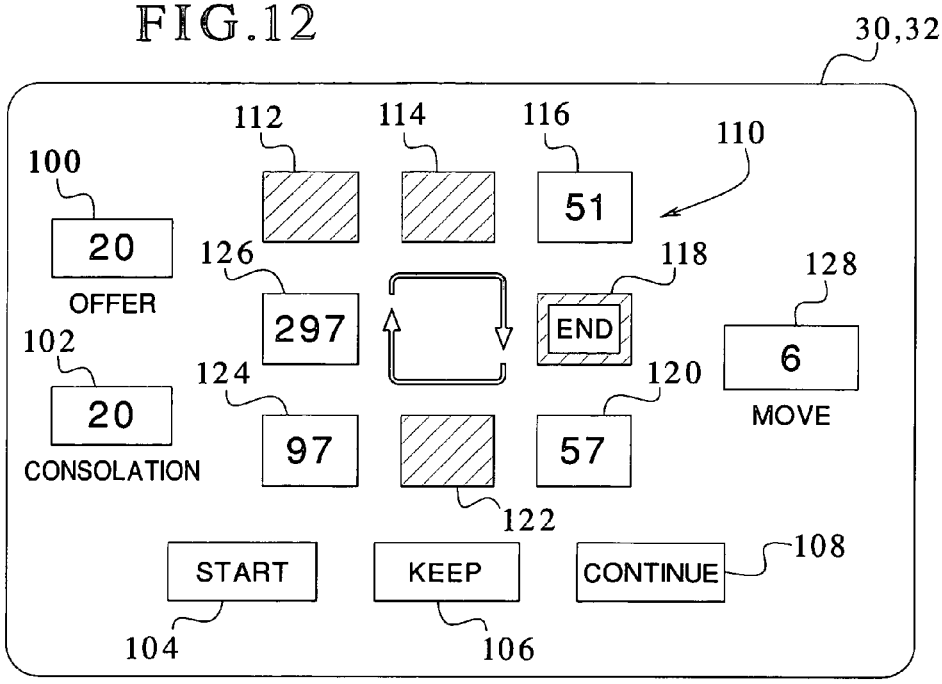

Referring now to FIG. 12, an enlarged front plan view of a display device 30 or 32 illustrates a fifth and final display of a preferred offer update embodiment, wherein the game awards a consolation award of twenty credits when the game generates a move to a previously selected position. As illustrated by the move indicator 128, when the player selects the continue selector 108 (in FIG. 11), the game randomly generates a move of six positions, e.g., by randomly selecting the number six from the move table 134 of FIG. 6. The game moves a marker 136, the $, from the previous position 122 six positions to the previously selected position 118. The game provides the player with the consolation award because the player has risked a current award of thirty-six credits and inputted a decision that generates a game ending move number. The example illustrates that the game displays the consolation award in offer indicator 100 as well as the consolation award indicator 102. The game employs any suitable method to indicate that the game has ended and the value of the player's award.

Figure 13:
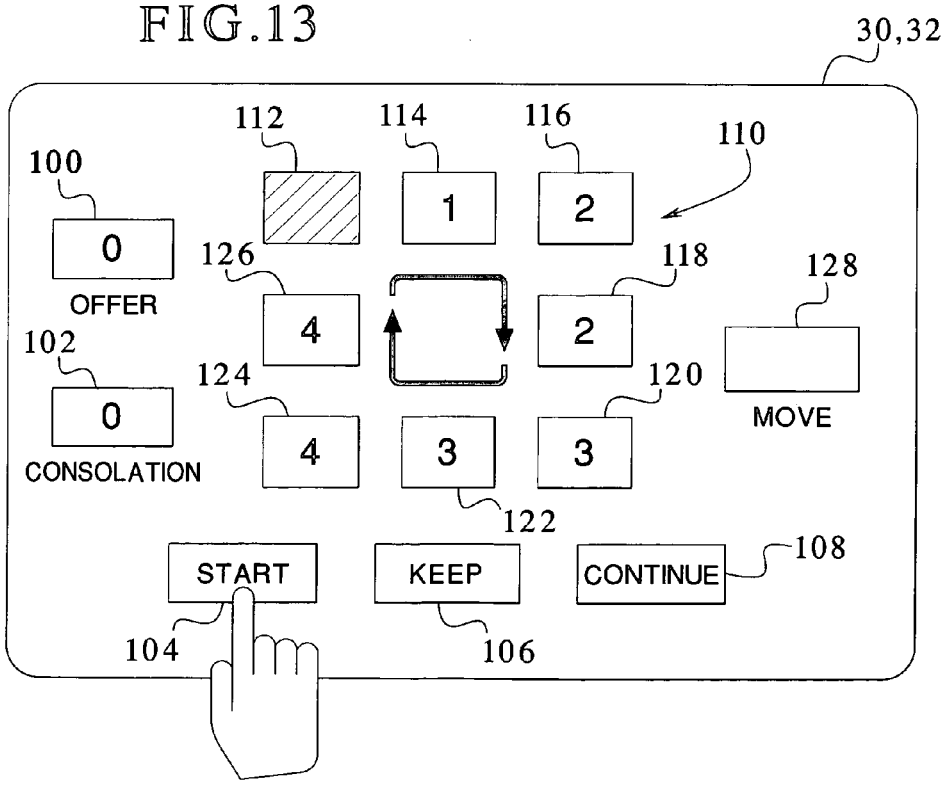
FIGS. 13 to 17 are front plan views of a display device illustrating an alternative embodiment disclosed herein having movement along a path, wherein the game multiplies a randomly selected or landed upon offer by the remaining unselected offers.

Referring now to FIG. 13, an enlarged front plan view of a display device 30 or 32 illustrates a first display of an alternative offer update embodiment, wherein the game multiplies a randomly selected or landed upon offer by the remaining unselected awards. The alternative embodiment otherwise operates as described in the addition embodiment of FIGS. 8 through 12.

Upon a sequence triggering event, one of the displays 30 or 32 shows the player that no offers exist in the offer indicator 100. The game has yet to generate a consolation award in the consolation award indicator 102. The player has yet to input a decision enabling the game to generate a position move number, as indicated by the move indicator 128. The displays 30 or 32 show that the present invention retrieves the offers one, two, two, three, three, four and four from an offer table and sequentially, increasingly displays the offers in the positions 114 through 126, respectively. The game selects and displays that the player starts from the position 112 and travels clockwise around the path 110. Initially, the game preferably enables the player to select the start selector 104 and not the offer/acceptance selectors, i.e., the keep selector 106 or the continue selector 108. Accordingly, the player in this example selects the start selector 104.

Figure 14:
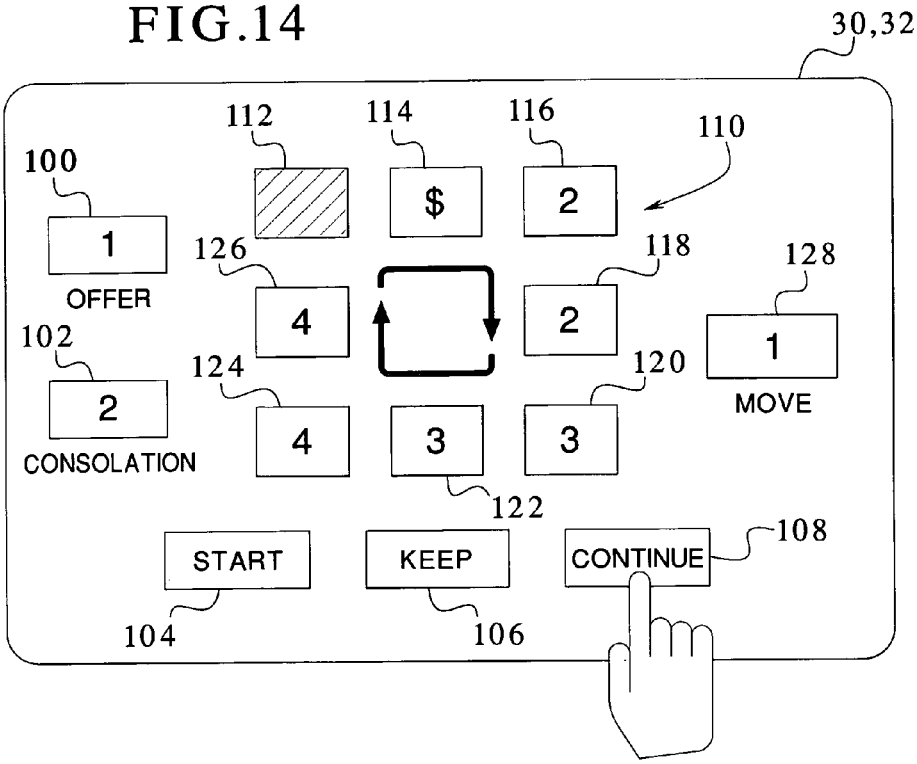

Referring now to FIG. 14, an enlarged front elevational view of a display device 30 or 32 illustrates a second display of an alternative offer update embodiment. After selecting the start selector 104, the game: (i) randomly generates a one position move as indicated by the move indicator 128; (ii) offers the player the one credit previously displayed in the position 114 as indicated by the offer indicator 100; (iii) multiplies the one credit by the remaining unselected offers of the positions 116 though 126; (iv) randomly generates a consolation award of two credits and displays such in the consolation award display 102; and (v) enables the player to accept or keep the achieved offer or risk the offer for an upgrade. In this example, the player rejects the offer and selects the continue selector 108, as illustrated.

Figure 15:
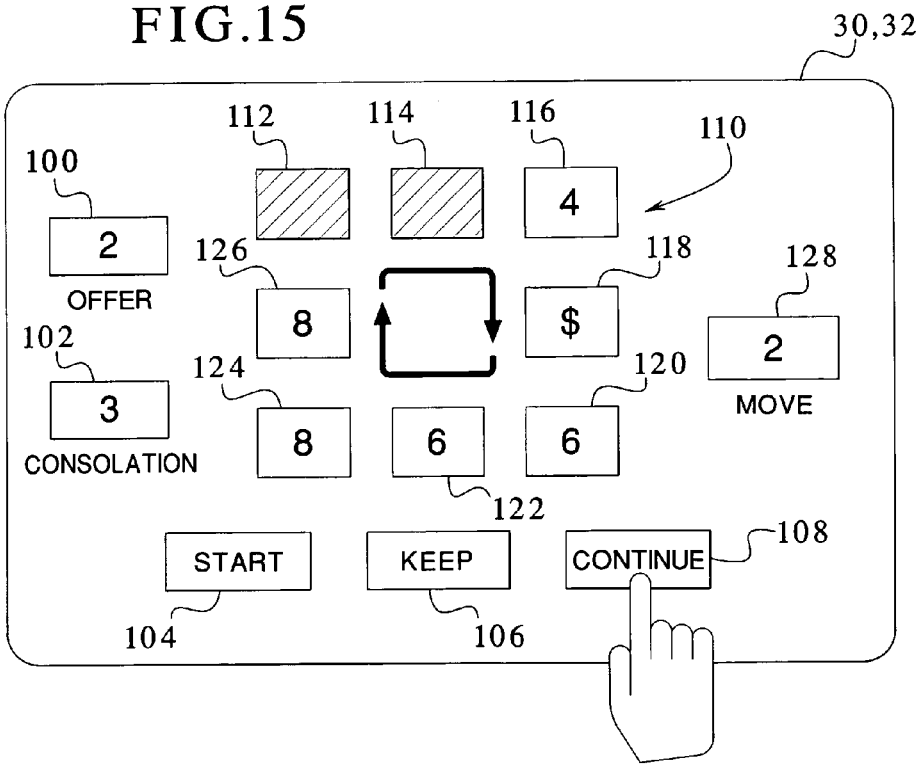

Referring now to FIG. 15, an enlarged front elevational view of a display device 30 or 32 illustrates a third display of an alternative offer update embodiment. After selecting the continue selector 108, the game: (i) randomly generates a two position move as indicated by the move indicator 128; (ii) offers the player the two credits previously displayed in the position 118 as indicated by the offer indicator 100; (iii) multiplies the two credits by the remaining unselected offers of the positions 116, and 120 though 126; (iv) randomly generates a consolation award of three credits and displays such in the consolation award display 102; and (v) enables the player to accept or keep the achieved offer or risk the offer for an upgrade. In this example, the player rejects the offer and selects the continue selector 108, as illustrated.

Figure 16:
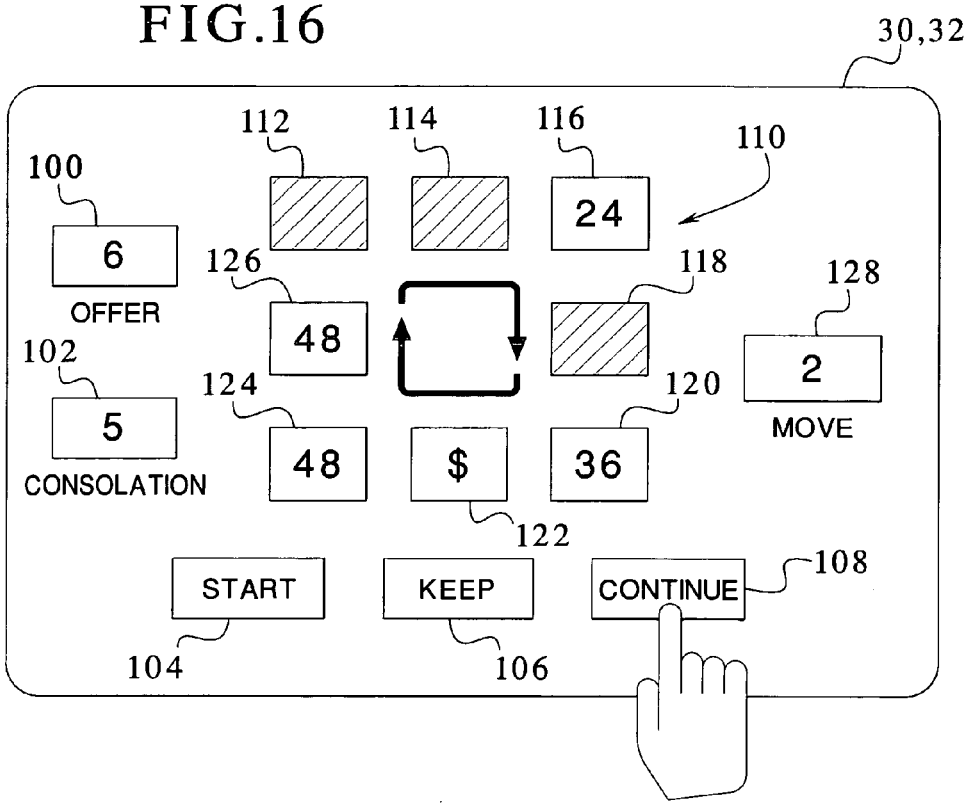

Referring now to FIG. 16, an enlarged front elevational view of a display device 30 or 32 illustrates a fourth display of an alternative offer update embodiment. After selecting the continue selector 108, the game: (i) randomly generates a two position move as indicated by the move indicator 128; (ii) offers the player the six credits previously displayed in the position 122 as indicated by the offer indicator 100; (iii) multiplies the six offer by the remaining unselected offer of the positions 116, 120, 124 and 126; (iv) randomly generates a consolation award of five credits and displays such in the consolation award display 102; and (v) enables the player to accept or keep the achieved offer or risk the offer for an upgrade. In this example, the player rejects the offer and selects the continue selector 108, as illustrated.

Figure 17:
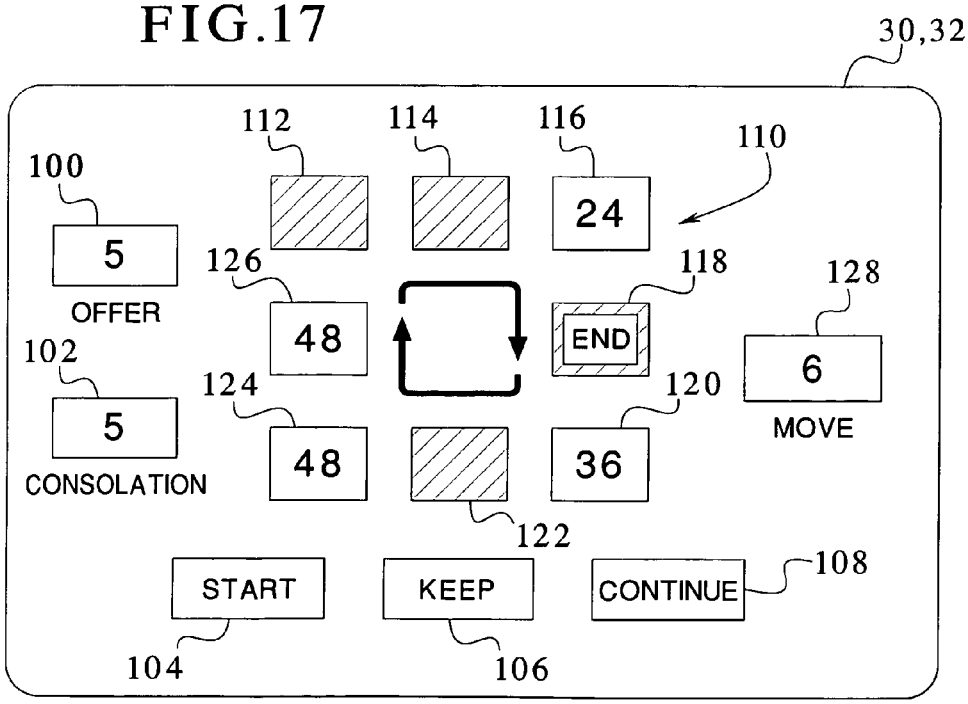

Referring now to FIG. 17, an enlarged front elevational view of a display device 30 or 32 illustrates a fifth and final display of an alternative offer update embodiment. After selecting the continue selector 108, the game randomly generates a six position move as indicated by the move indicator 128, which selects a previously selected position 118. The game as previously described ends and replaces the currently achieved offer with the consolation award of five credits, which the game displays in the offer indicator 100.

Alternative Path Embodiment

Figure 18:
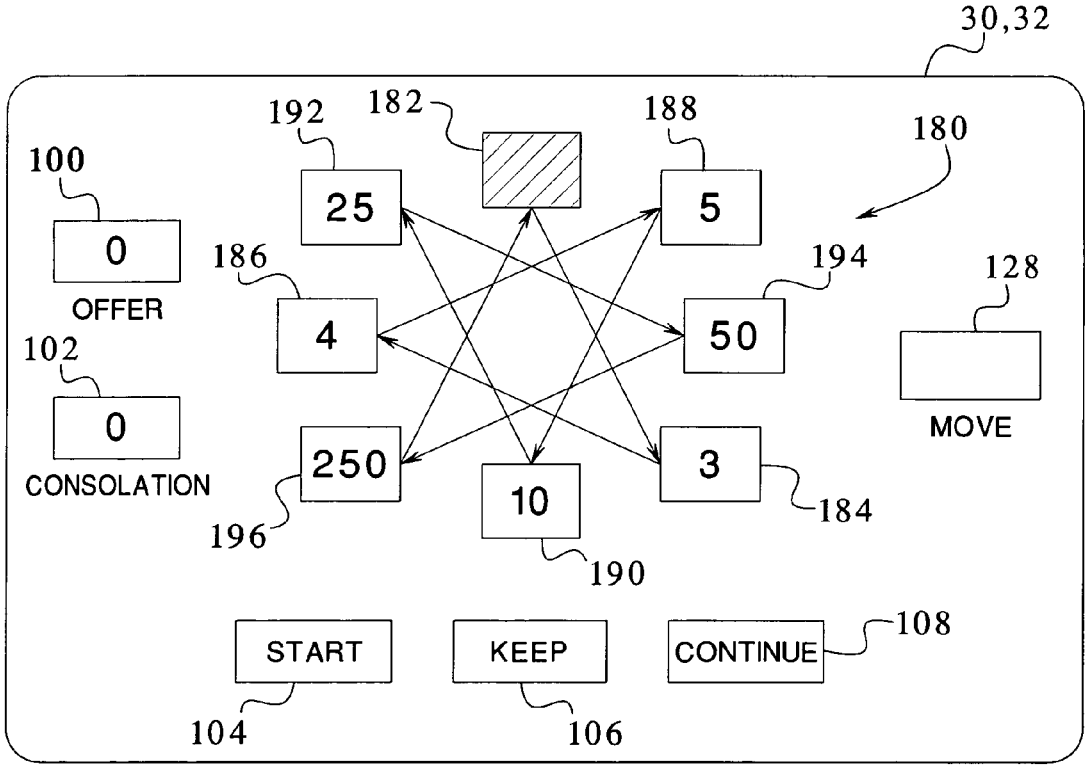
FIG. 18 is a front elevational view of a display device illustrating an alternative embodiment disclosed herein having an alternative path.

Referring now to FIG. 18, an enlarged front elevational view of a display device 30 or 32 illustrates an alternative path embodiment of the present invention. The present invention contemplates employing any group of positions, wherein the game moves a marker, such as the dollar sign, from position to position in a predetermined and consistent order. As illustrated by FIG. 18, the path can be of any enclosed configuration. The embodiment of FIG. 18 includes the offer indicator 100, the consolation award indicator 102, the start selector 104, the keep selector 106, the continue selector 108 and the position move indicator 128, as described above. The embodiment also includes the path 180, wherein a marker starts at the position 182 and moves to the position 184, to the position 186, to the position 188, to the position 190, to the position 192, to the position 194, to the position 196 and then back to the position 182. The path 180 creates an enclosed star pattern as illustrated. As above, the game retrieves an offer from the offer table 130 of FIG. 4, and sequentially, increasingly displays the offer in the positions 184 to 196, respectively.

Alternative No-Path Embodiment

Figure 19:
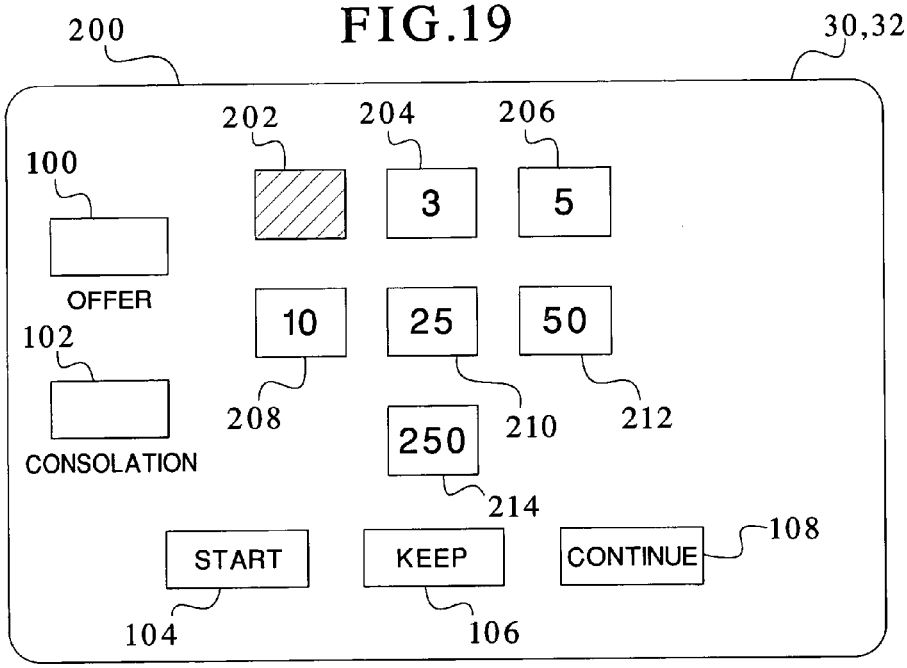
FIG. 19 is a front elevational view of a display device illustrating an alternative embodiment disclosed herein, wherein the game randomly generates offers without respect to a path or spatial relationship between the award displays.

Referring now to FIG. 19, an enlarged front elevational view of a display device 30 or 32 illustrates a further alternative no-path embodiment of the present invention. The present invention includes employing any group of indicators, which indicate or display potential offers to the player, wherein one of the potential offers is provided to the player, and wherein the player can: (i) accept or keep such offer; or (ii) reject or continue while risking the currently achieved offer.

This embodiment does not include a predetermined path, nor does it include the position move indicator 128 (FIG. 3). This embodiment also does include the offer indicator 100, the consolation award indicator 102, the start selector 104, the keep selector 106, the continue selector 108 and their associated functionality, as described above.

This embodiment also includes the offer displays 204 through 214. The display 202 is the start display, which does not include an offer. Since this embodiment does not include a path, a start display 202 is not necessary, in which case upon selecting the start selector 104, the game randomly generates preferably any one of the displayed potential offers to offer to the player. Whether or not the game includes a start display 202, upon selecting the start selector 104, the game randomly generates preferably any one of the displayed potential offers 204 through 214 and a consolation award, which is displayed on the consolation award indicator 102.

The game adds or multiplies the generated offer to all other unselected potential offers and updates the offer displays 204 through 214, accordingly. In one embodiment, the game does not add to, multiply or update previously generated offers or the start indicator 202. The game displays the currently achieved offer in the offer indicator 100. The player then accepts or keeps the achieved offer by choosing the keep selector 106. The player alternatively rejects and risks the achieved offer by choosing the continue selector 108. If the player continues and the game generates a previously generated offer or the start indicator 202, the game ends and the player receives a consolation award.

Upon selecting the continue selector 108, the game randomly generates any of the remaining potential offers, without regard to a path or any spatial relationship between any two or more offers. In this manner, the game enables the player to sequentially continue and reject currently achieved offers until the game randomly generates each potential offer or until the game generates a previously generated offer. The game likewise enables the player to stop at any point and accept or keep a currently achieved offer. Thus, it should be appreciated that the game replaces the potential offers with new potential offers, wherein the new potential offers are based on the previous offer and the previous potential offers. That is, the game replaces a first set of potential offers with a second set of potential offers.

Alternative No-Path, No Consolation Embodiment

Figure 20:
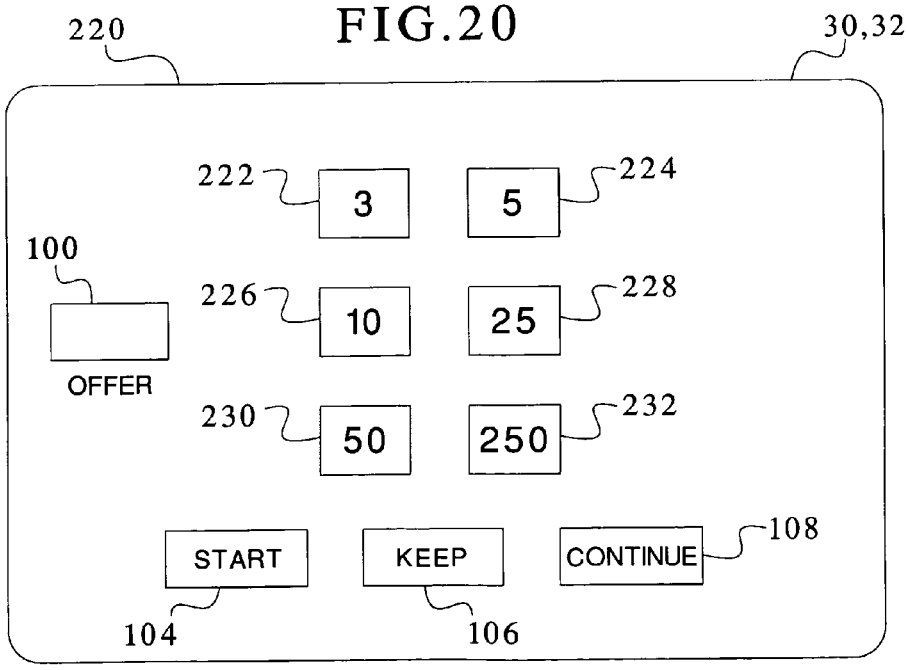
FIG. 20 is a front elevational view of a display device illustrating an alternative embodiment disclosed herein, wherein the game randomly generates offers without respect to a path or spatial relationship between the offer displays, and wherein the game includes awarding a reselected offer rather than a consolation award.

Referring now to FIG. 20, an enlarged front elevational view of a display device 30 or 32 illustrates yet another alternative no-path, no-consolation embodiment of the present invention. The present invention includes employing any group of indicators, which indicate or display offers to the player, wherein one of the offers is made to the player, and wherein the player can: (i) accept or keep such offer; or (ii) reject or continue while risking the currently achieved offer.

This embodiment does not include a predetermined path, the position move indicator 128 or a consolation award. This embodiment also does include the award indicator 100, the start selector 104, the keep selector 106, and the continue selector 108, and their associated functionality, as described above.

The embodiment 220 also includes the offer displays 222 through 232 and may or may not include a start display as in the embodiment of FIG. 19. Upon selecting the start selector 104, the game randomly generates any one of the displayed offers 222 through 232. The game adds or multiplies the generated offer to all other unselected offers and updates the offer displays 222 through 232, accordingly. In one embodiment, the game does not add to, multiply or update previously generated offers. The game displays the currently achieved offer in the offer indicator 100.

The player then accepts or keeps the achieved offer by choosing the keep selector 106. The player alternatively rejects and risks the achieved offer by choosing the continue selector 108. If the player continues and the game generates a previously generated offer, the game ends and the player receives the reselected offer.

Upon selecting the continue selector 108, the game randomly generates any of the offers, without regard to a path or any spatial relationship between any two or more offers. In this manner, the game enables the player to sequentially continue and reject currently achieved offers until the game randomly generates each offer or until the game generates a previously generated offer. The game likewise enables the player to stop at any point and accept or keep a currently achieved offer. It should be also be appreciated that the number of new offers may be limited by a maximum number of selections. Thus, it should again be appreciated that the game replaces the potential offers with new potential offers, wherein the new potential offers are based on the previous offer and the previous potential offers. That is, the game replaces a first set of potential offers with a second set of potential offers.

Alternative Award Embodiment

The present invention contemplates enabling a player, in any of the display configurations described in FIGS. 3, 18, 19 and 20, to accrue offers, wherein the positions do not update; but rather, the game adds and displays the offers of the individual positions. Referring to FIG. 3, if the game adds individual offers, then: (i) the player obtains three credits in a move from the position 112 to the position 114; (ii) the player obtains five more credits in a move from the position 114 to the position 118 for a total of eight; (iii) the player obtains twenty-five more credits in a move from the position 118 to the position 122 for a total of thirty-three, etc. The offers of the positions do not change or update as above, but the game preferably adds individual offers rather than replacing them.

The present invention also contemplates enabling a player, in any of the display configurations described in FIGS. 3, 18, 19 and 20, to accrue offers, wherein the positions do not update; but rather, the game multiplies and displays the offers of the individual positions. Referring to FIG. 13, if the game multiplies individual offers, then: (i) if the player begins the game with one credit at the position 112; (ii) the player maintains one credit (1×1) in a move from the position 112 to the position 114; (ii) the player accrues two credits (1×2) in a move from the position 114 to the position 118; (iii) the player accrues six credits (2×3) in a move from the position 118 to the position 122, etc. The offers of the positions do not change or update as above, but the game preferably multiplies individual offers rather than replacing them.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A method of operating a gaming device, said method comprising:

(a) for each play of a game, causing a processor to execute a plurality of instructions to control said play of the game by:

(i) causing at least one display device to display a plurality of first potential offers;

(ii) enabling a player to accept or reject a first offer, wherein said first offer is one of the plurality of first potential offers;

(iii) if the player accepts the first offer, providing the first offer to the player; and (iv) if the player rejects the first offer:

(A) replacing a plurality of said first potential offers with a plurality of different second potential offers, wherein each of said plurality of different second potential offers is based on a total value of all of the rejected offers, (B) determining a second offer selected from one of the plurality of first potential offers and said plurality of different second potential offers, (C) enabling the player to accept or reject the second offer, and (D) providing the player the second offer if the player accepts said second offer.

2. The method of claim 1, wherein if the player rejects the first offer, said method includes replacing the plurality of first potential offers with said plurality of second potential offers.

3. The method of claim 2, which includes enabling the player to accept or reject the second offer from the plurality of second potential offers.

4. The method of claim 1, wherein each of the plurality of second potential offers equals one of the first potential offers plus the total value of all of the rejected offers offered to the player to accept or reject.

5. The method of claim 1, which includes randomly determining which of said first potential offers to replace with one of the plurality of different second potential offers.

6. The method of claim 1, which includes replacing at least one of said first potential offers with a terminator.

7. The method of claim 6, which included providing either the terminator or the second offer if the player rejects the first offer.

8. The method of claim 1, which is provided through a data network.

9. The method of claim 8, wherein the data network is an internet.

10. A method of operating a gaming device, said method comprising:

(a) for each play of a game, causing a processor to execute a plurality of instructions to control said play of the game by:

(i) causing at least one display device to display a plurality of potential offers;

(ii) enabling a player to accept or reject a first offer, wherein said first offer is one of the plurality of potential offers;

(iii) if the player accepts the first offer, providing said first offer to the player; and (iv) if the player rejects the first offer:

(A) determining whether to provide a terminator or enable the player to accept or reject a second offer selected from one of the potential offers and a plurality of second potential offers, wherein each of said plurality of second potential offers equals a sum of each of the rejected offers plus one of the potential offers and said plurality of second potential offers are different than any of said potential offers, and (B) providing the player the second offer if the determination is to enable the player to accept or reject the second offer and the player accepts said second offer.

11. The method of claim 10, which includes providing the player a consolation award if the determination is to provide the terminator.

12. The method of claim 10, which includes providing a third offer to the player if the player rejects the second offer, wherein the third offer is a combination of the second offer and one of the potential offers.

13. The method of claim 10, wherein if the player rejects the first offer, said method includes adding the first offer to a plurality of said potential offers and selecting the second offer from each of the remaining potential offers.

14. The method of claim 10, which is provided through a data network.

15. The method of claim 14, wherein the data network is an internet.

16. A method of operating a gaming device, said method comprising:

(a) for each play of a game, causing a processor to execute a plurality of instructions to control said play of the game by:

(i) causing at least one display device to display a plurality of first values;

(ii) enabling a player to accept or reject a selected one of said first values;

(iii) if the player accepts said selected one of the first values, providing said first value to the player; and (iv) if the player rejects said selected one of the first values:

(A) changing a plurality of the first values based on each of the rejected values, wherein each of said changed values is different than any of said plurality of first values, (B) enabling the player to accept or reject at least one of: one of said plurality of changed values and another one of said plurality of first values, and (C) providing any subsequently accepted value to the player.

17. The method of claim 16, wherein changing a plurality of the first values includes increasing at least one of said first values based on each of the rejected values.

18. The method of claim 16, wherein changing a plurality of the first values includes increasing a plurality of the first values not offered to the player based on each of the rejected values.

19. The method of claim 16, wherein changing a plurality of the first values includes increasing at least one of the first values not offered to the player based on each of the rejected values.

20. The method of claim 16, which is provided through a data network.

21. The method of claim 20, wherein the data network is an internet.

22. method of operating a gaming device, said method comprising:

(a) for each play of a game, causing a processor to execute a plurality of instructions to control said play of the game by:

(i) causing at least display device to display a plurality of potential first offers;

(ii) providing a first offer from the potential first offers to a player to accept or reject;

(iii) if the player accepts the first offer, providing the first offer to the player; and (iv) if the player rejects the first offer, providing a second offer selected from one of the potential first offers and a plurality of second potential offers for the player to accept or reject, wherein each of the plurality of second potential offers is based on a total value of each offer rejected by the player and each of the plurality of second potential offers is different than any of the potential first offers.

23. The method of claim 22, wherein each of said second potential offers is based on an addition of the value of each previously displayed potential offer.

24. The method of claim 22, wherein each of said second potential offers is based on a multiplication of the value of each previously displayed potential offer.

25. The method of claim 22, which includes causing the at least one display device to display a consolation award.

26. The method of claim 25, which includes increasing said consolation award if the player rejects the first offer.

27. The method of claim 25, which includes providing said consolation award to the player if said provided offer is one of said offers rejected by the player.

28. The method of claim 22, which is provided through a data network.

29. The method of claim 28, wherein the data network is an internet."

* * * * *

UNITED STATES PATENT AND TRADEMARK OFFICE

CERTIFICATE OF CORRECTION

PATENT NO. : 7,572,184 B2
APPLICATION NO. : 11/222695
DATED : August 11, 2009
INVENTOR(S) : Anthony J. Baerlocher et al.

It is certified that error appears in the above-identified patent and that said Letters Patent is hereby corrected as shown below:

IN THE CLAIMS:

In Claim 22, Column 18, Line 25, change "22. method" to --22. A method--.

In Claim 22, Column 18, Line 35, change ";and (iv) if the player" to

--; and (iv) if the player--.

Signed and Sealed this

Twenty-seventh Day of October, 2009

David J. Kappos

David J. Kappos
*Director of the United States Patent and Trademark Office*